US010478898B2

(12) United States Patent
Chang et al.

(10) Patent No.: US 10,478,898 B2
(45) Date of Patent: Nov. 19, 2019

(54) SILVER PARTICLES MANUFACTURING METHOD

(71) Applicant: National Chung-Shan Institute of Science and Technology, Taoyuan County (TW)

(72) Inventors: Chien-Liang Chang, Taoyuan County (TW); Wu-Ching Hung, Taoyuan County (TW); Wei-Jen Liu, Taoyuan County (TW); Kuei-Ting Hsu, Taoyuan County (TW); Jhao-Yi Wu, Taoyuan County (TW); Pin-Chun Lin, Taoyuan County (TW)

(73) Assignee: NATIONAL CHUNG-SHAN INSTITUTE OF SCIENCE AND TECHNOLOGY, Taoyuan County (TW)

( * ) Notice: Subject to any disclaimer, the term of this patent is extended or adjusted under 35 U.S.C. 154(b) by 301 days.

(21) Appl. No.: 14/961,889

(22) Filed: Dec. 8, 2015

(65) Prior Publication Data

US 2017/0157675 A1 Jun. 8, 2017

(51) Int. Cl.

| | |
|---|---|
| ***B22F 9/24*** | (2006.01) |
| ***B03D 3/00*** | (2006.01) |
| ***B22F 1/00*** | (2006.01) |
| ***B22F 9/06*** | (2006.01) |

(52) U.S. Cl.

CPC . *B22F 9/24* (2013.01); *B03D 3/00* (2013.01)

(58) Field of Classification Search

USPC ..... 75/345; 423/23

See application file for complete search history.

(56) References Cited

U.S. PATENT DOCUMENTS

| | | | | |
|---|---|---|---|---|
| 9,487,399 | B2 * | 11/2016 | Ghanavi | B22F 1/0018 |
| 2008/0145560 | A1 * | 6/2008 | Khaselev | C09D 11/30 427/466 |
| 2015/0159029 | A1 * | 6/2015 | Andre | C09D 5/24 427/256 |

OTHER PUBLICATIONS

Jeon, Sea-Ho, et al. "Understanding and Controlled Growth of Silver Nanoparticles Using Oxidized N-Methyl-Pyrrolidone as a Reducing Agent." The Journal of Physical Chemistry C, vol. 114, No. 1, 2009, pp. 36-40. (Year: 2009).*

Lyutakov, O., Kalachyova, Y., Solovyev, A. et al. J Nanopart Res (2015) 17: 120. (Year: 2014).*

(Continued)

*Primary Examiner* — Colleen P Dunn
*Assistant Examiner* — Jeremy C Jones
(74) *Attorney, Agent, or Firm* — Chun-Ming Shih

(57) ABSTRACT

A silver particles manufacturing method comprises following steps: providing a silver containing compound; providing an organic solution; adding the silver containing compound into the organic solution, to perform ultrasonic vibrations or a heating process until the silver containing compound is dissolved completely into the organic solution, to form a silver ion solution; performing the ultrasonic vibrations or the heating process, and then let the solution settle down for a period, to form a silver particles synthesized solution; and placing the silver particles synthesized solution into a centrifuge to perform centrifugation and separation, to obtain μm-scale silver particles and nm-scale silver particles. The silver particles manufacturing method has the advantages of low pollution, low cost, high yield, and mass production.

6 Claims, 5 Drawing Sheets

(56) References Cited

OTHER PUBLICATIONS

Kim, Mun Ho, et al. "Synthesis of Silver Nanoplates with Controlled Shapes by Reducing Silver Nitrate with Poly(Vinyl Pyrrolidone) in N-Methylpyrrolidone." CrystEngComm, vol. 15, No. 23, Apr. 10, 2013, pp. 4660-4666., doi:10.1039/c3ce40096d. (Year: 2013).*

Shin, Hyeon Suk, et al. "Mechanism of Growth of Colloidal Silver Nanoparticles Stabilized by Polyvinyl Pyrrolidone in γ-Irradiated Silver Nitrate Solution." Journal of Colloid and Interface Science, vol. 274, No. 1, Jun. 1, 2004, pp. 89-94. (Year: 2004).*

* cited by examiner

SILVER PARTICLES MANUFACTURING METHOD

BACKGROUND OF THE INVENTION

Field of the Invention

The present invention relates to a particles manufacturing method, and in particular to a silver particles manufacturing method.

The Prior Arts

Presently, silver particle, especially nm-scale silver particle is the major material utilized extensively in producing solar cells, printed circuit boards, and other photo-electronics related industries. Due to its advantages of having large surface area, the functions and capabilities of the nm-scale silver particles are raised significantly. As such, it has been used in producing products of various applications, such as conductive printing ink, electronic products, cosmetics, medical products, textiles, paint, pigment, spraying material. Since the price of silver particle is high, and it is used in large quantity in the Industries, in case a silver particles producing method can be developed, capable of achieving low cost, zero pollution, and high yield, then it could reduce the production cost significantly for the industries requiring to use large amount of conductive silver glue, in raising the competitiveness of their products.

In the conventional technology, quite a lot of methods are available for producing silver particles. For example, chemical reduction method, high temperature thermal reduction method, electrochemical reduction method, microwave reduction method, hydrothermal reduction method, biological reduction method, and radiation exposure method. Wherein, the chemical reduction method is used most extensively, while the reduction agent used most frequently are sodium borohydride, tri-sodium citrate, and aniline, etc. In the electrochemical reduction method, silver electrode and platinum electrode are utilized to perform reduction of nm-scale silver particles through electrolysis. In the biological reduction method, microorganism and plant leaf extract fluid are utilized as reduction agent. Further, in the radiation exposure method, radiation such as ultraviolet light, microwave radiation, or stray radiation are used to perform reduction of nm-scale silver particles.

However, the silver particle manufacturing methods mentioned above all have their problems and shortcomings. For example, the reduction agent utilized in the chemical reduction method are highly toxic and dangerous. The high temperature thermal reduction method has to be performed in a reduction atmosphere of hydrogen in a temperature of over 500° C., that is highly dangerous and waste of energy. The electrochemical reduction method requires to use large amount of electrolysis fluid, such that it consumes large amount of electricity, while its yield is low. For the rest of the reduction methods for producing nm-scale silver particles, they have the drawbacks of having complicated steps or requiring to use devices that could cause radiation hazards.

Therefore, presently, the design and performance of the silver particles manufacturing method is not quite satisfactory, and it leaves much room for improvement.

SUMMARY OF THE INVENTION

In view of the problems and drawbacks of the prior art, the present invention provides a silver particles manufacturing method utilizing chemical reduction, without the need to add in reduction agents in the manufacturing process, to overcome the shortcomings of the prior art.

The present invention provides a silver particles manufacturing method, comprising following steps: providing a silver containing compound; providing an organic solution; adding the silver containing compound into the organic solution, to perform ultrasonic vibrations or a heating process until the silver containing compound is dissolved completely into the organic solution, to form a silver ion solution; performing the ultrasonic vibrations or a heating process to the solution, and then let the solution settle down for a period, to form a silver particles synthesized solution; and placing the silver particles synthesized solution into a centrifuge to perform centrifugation and separation, to obtain μm-scale particles (lower layer powder) and nm-scale particles (upper layer solution). The silver particles manufacturing method mentioned above is referred to as a first category embodiment.

In the steps mentioned above, the silver containing compound is silver nitride ($AgNO_3$) powder, while the organic solution is N-Methyl Pyrrolidone (NMP) solution.

The present invention further provides another silver particles manufacturing method, without the need to add in reduction agents in the manufacturing process, comprising the following steps: providing a silver containing compound; providing an organic solution; adding the silver containing compound into the organic solution, to perform ultrasonic vibrations or a heating process until the silver containing compound is dissolved completely into the organic solution, to form a silver ion solution; providing a polymer additive; putting the polymer additive into the silver ion solution, to form a silver ion solution containing polymer; performing the ultrasonic vibrations or a heating process for the silver ion solution containing polymer, and then let the solution settle down for a period of time, to form a silver particles synthesized solution; and placing the silver particles synthesized solution into a centrifuge to perform centrifugation and separation, to obtain μm-scale particles and nm-scale particles. The silver particles manufacturing method mentioned above is referred to as a second category embodiment.

In the descriptions above, the silver containing compound is silver nitride ($AgNO_3$) powder, while the organic solution is N-Methyl Pyrrolidone (NMP) solution, but the present invention is not limited to this. The silver ion concentration of the silver ion solution is 0.001M to 10M. The polymer additive can be Poly (Methyl Methacrylate) (PMMA) and Polyethylene Terephthalate (PET). The amount of the polymer additive added is preferably 1 wt % to 3 wt %. But the present invention is not limited to this.

Compared with the existing technology, in the present invention, reduction agent need not to be added, that is tonic and dangerous. Also, in the present invention, the silver particles can be produced through merely performing heating or ultrasonic vibration process for the silver ion solution and the silver ion solution containing polymer. Further, polymer additive can be added, to raise the yield of the silver particles. Therefore, the present invention has the advantages of low pollution, low cost, high yield, and mass production, thus having a good competitiveness in the market.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from these detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Refer to FIGS. 1 to 6 respectively for a flowchart of the steps of a silver particles manufacturing method according to a first category embodiment of the present invention; a flowchart of the steps of a silver particles manufacturing method according to a second category embodiment of the present invention; a scanning photograph of nm-scale silver particles obtained through using an electronic microscope according to the present invention; a scanning photograph of μm-scale silver particles obtained through using an electronic microscope according to the present invention; a spectrum of the silver particles manufactured according to the present invention; and an X-ray diffraction pattern of the silver particles manufactured according to the present invention.

Figure 1:
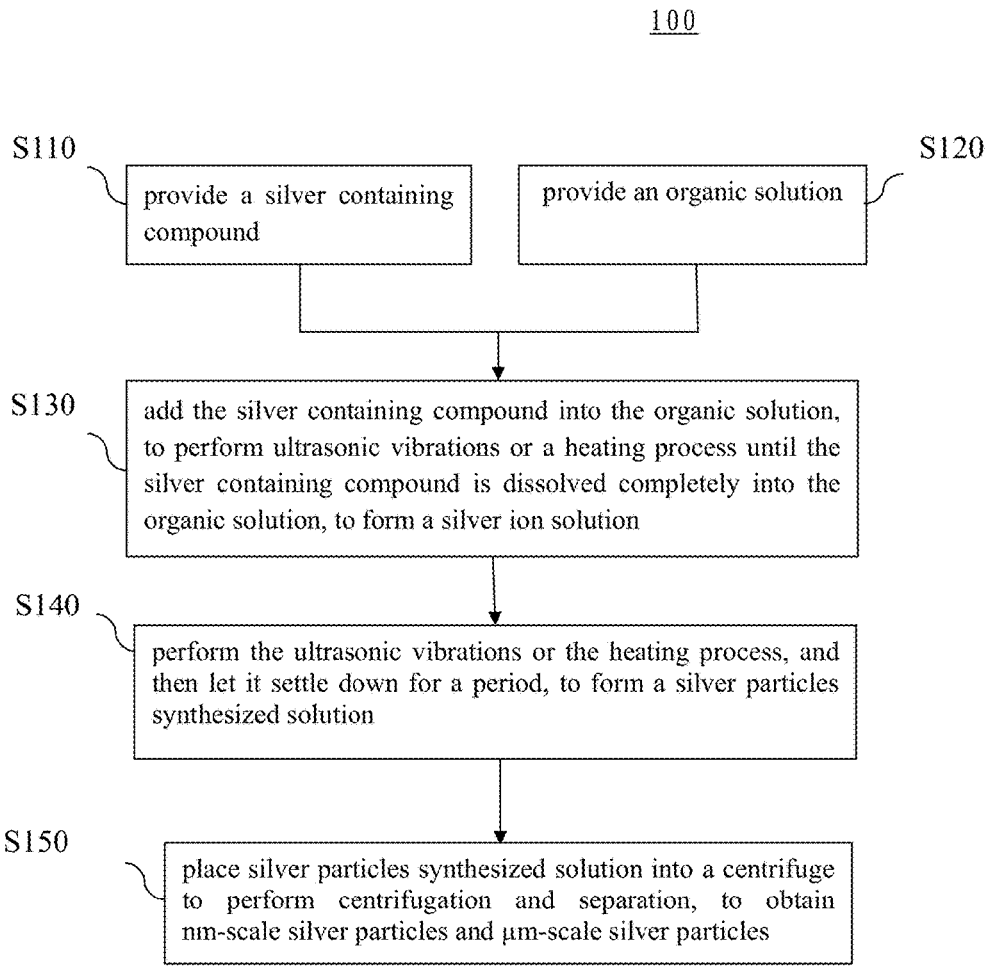
FIG. 1 is a flowchart of the steps of a silver particles manufacturing method according to a first category embodiment of the present invention.

As shown in FIG. 1, the silver particles manufacturing method 100 includes the following steps: providing a silver containing compound (step S110); providing an organic solution (step S120); adding the silver containing compound into the organic solution, to perform ultrasonic vibrations or a heating process until the silver containing compound is dissolved completely into the organic solution, to form a silver ion solution (step S130). For the steps mentioned above, the silver containing compound is silver nitride ($AgNO_3$) powder, the organic solution is N-Methyl Pyrrolidone (NMP) solution, while the silver ion concentration is 0.001M to 10M. But the present invention is not limited to this.

Moreover, the silver particles manufacturing method includes the following steps: performing ultrasonic vibrations or a heating process for the silver ion solution, and then let the solution settle down for a period of time, to obtain a silver particles synthesized solution (step S140). In the step mentioned above, the heating temperature is 30° C. to 110° C., and the heating is performed for a period of 1 second to 10 hours. On the other hand, the power required for the ultrasonic vibrations is 10 W to 1600 W, while the ultrasonic vibrations are performed for a period of 1 second to 10 hours. Further, the settle-down period is 1 to 30 days depending on requirement. But the present invention is not limited to this.

Further, the silver particles manufacturing method includes the following steps: placing the silver particles synthesized solution into a centrifuge to perform centrifugation and separation, to obtain nm-scale silver particles (upper layer solution) and μm-scale silver particles (lower layer powder), then the particles are rinsed with acetone several times, to complete manufacturing the nm-scale silver particles and the μm-scale silver particles (step S150). In the step mentioned above, the rotation speed of the centrifuge is 100 rpm to 15000 rpm, while the centrifugation is performed for a period of 1 second to 10 hours. But the present invention is not limited to this.

Figure 2:
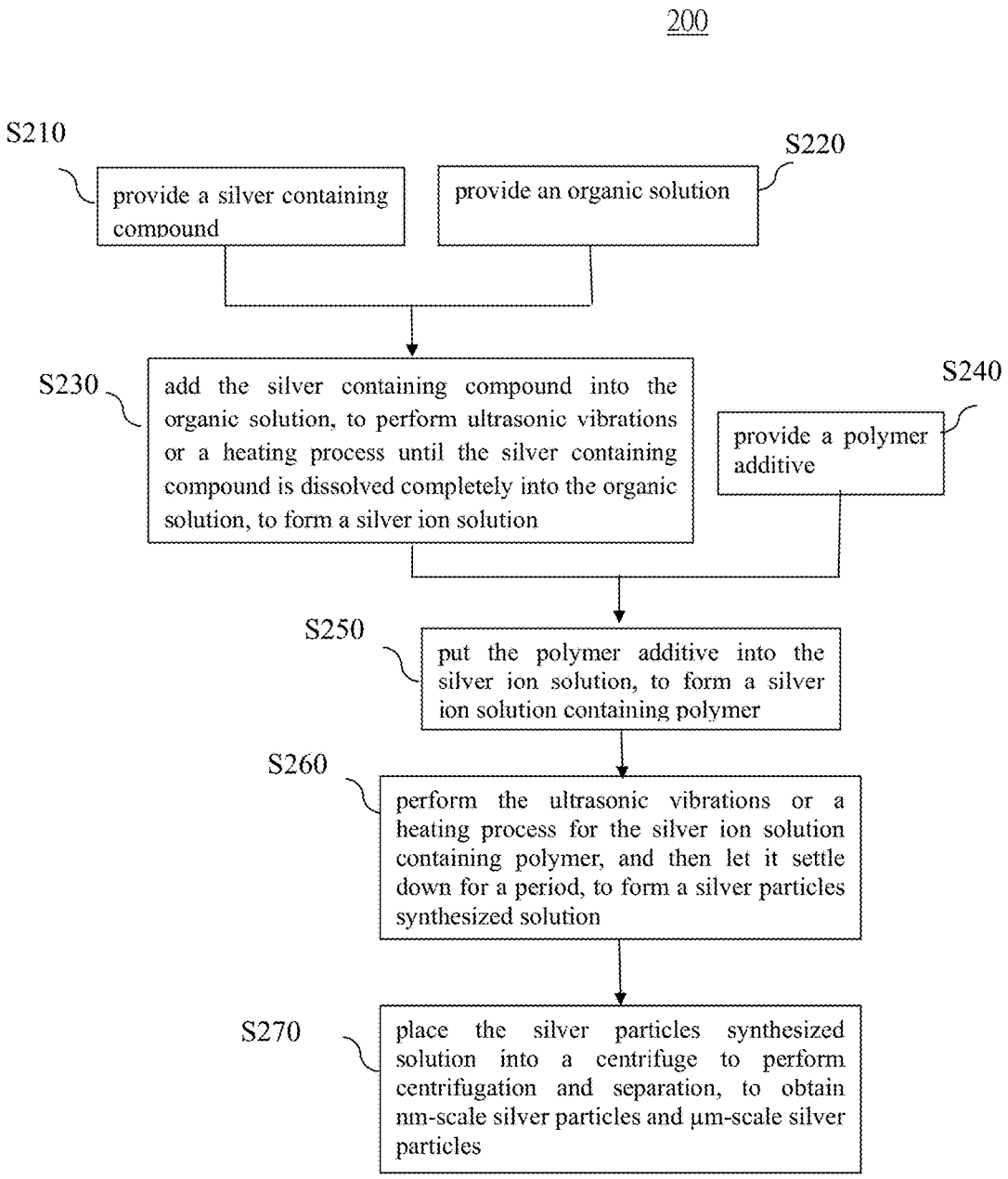
FIG. 2 is a flowchart of the steps of a silver particles manufacturing method according to a second category embodiment of the present invention.
Figure 3:
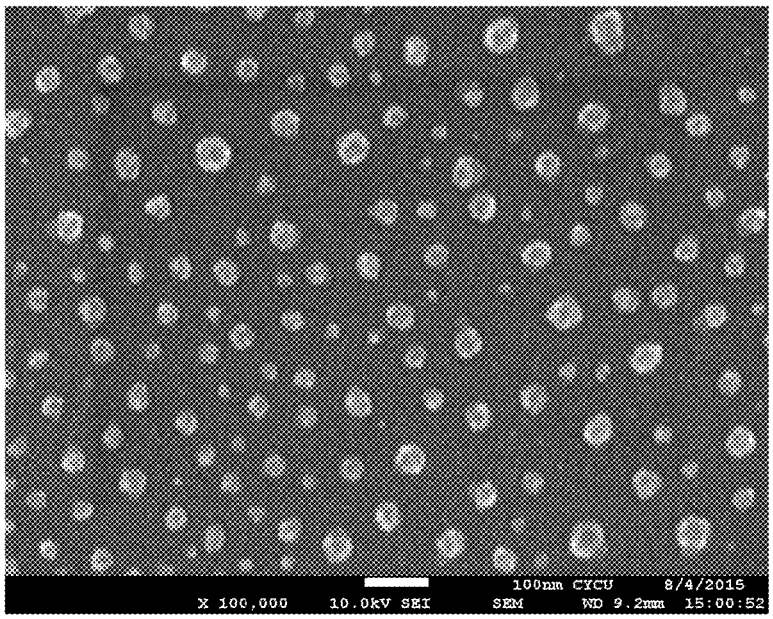
FIG. 3 is a scanning photograph of nm-scale silver particles obtained through using an electronic microscope according to the present invention.
Figure 4:
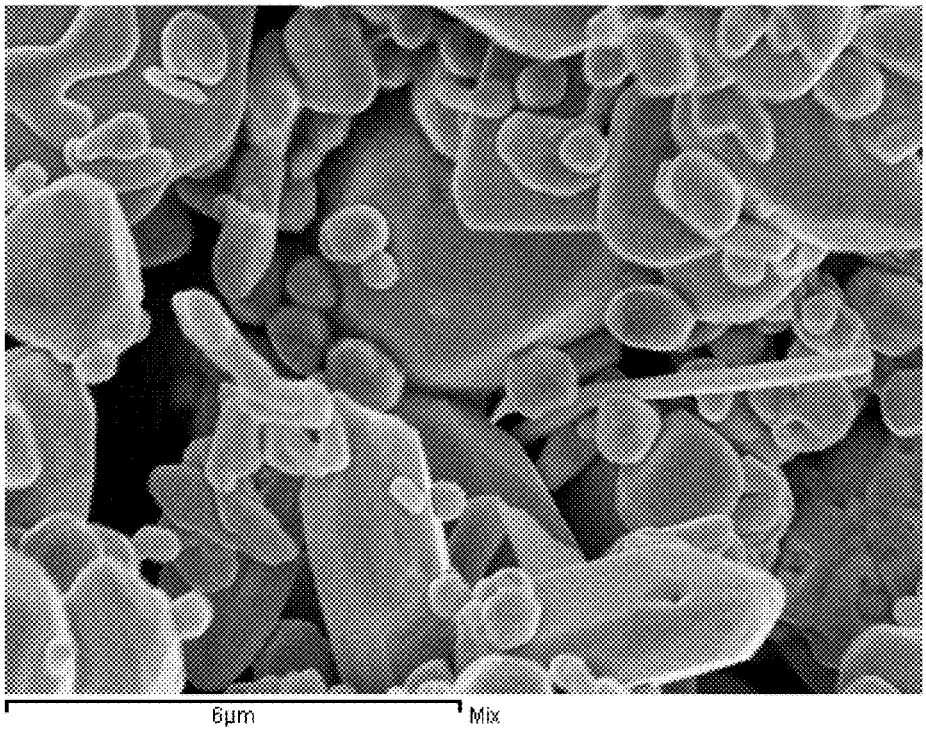
FIG. 4 is a scanning photograph of μm-scale silver particles obtained through using an electronic microscope according to the present invention.
Figure 5:
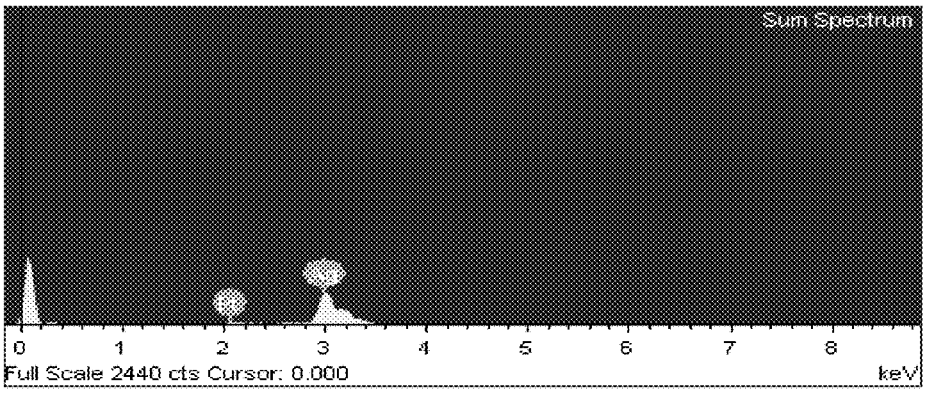
FIG. 5 is a spectrum of the silver particles manufactured according to the present invention.
Figure 6:
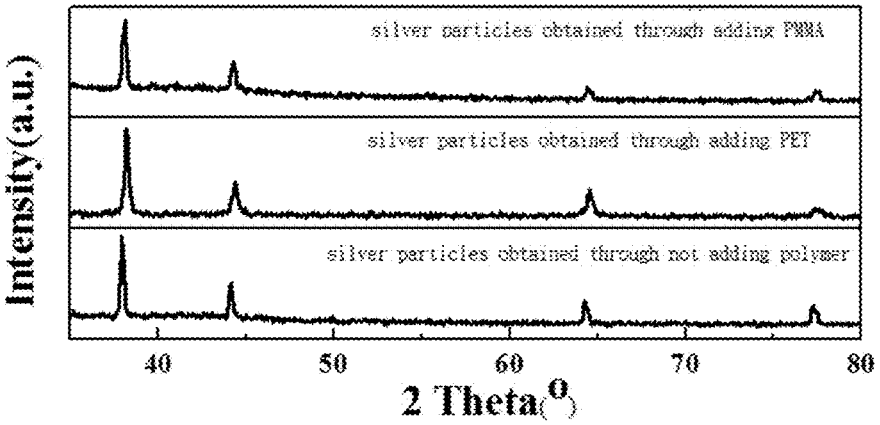
FIG. 6 is an X-ray diffraction pattern of the silver particles manufactured according to the present invention.

Then, refer to FIG. 2 for a flowchart of the steps of a silver particles manufacturing method according to a second category embodiment of the present invention. As shown in FIG. 2, the silver particles manufacturing method 200 includes the following steps: providing a silver containing compound (step S210); providing an organic solution (step S220); adding the silver containing compound into the organic solution, to perform ultrasonic vibrations or a heating process until the silver containing compound is dissolved completely into the organic solution, to form a silver ion solution (step S230). For the steps mentioned above, the silver containing compound is silver nitride ($AgNO_3$) powder, the organic solution is N-Methyl Pyrrolidone (NMP) solution, while the silver ion concentration is 0.001M to 10M. But the present invention is not limited to this.

Moreover, the silver particles manufacturing method further includes the following steps: providing a polymer additive (step S240). The polymer additive can be selected from one of the following group consisting of: Polyethylene Terephthalate (PET), Poly (Methyl Methacrylate) (PMMA), Polyvinylidene Fluoride (PVDF), Polyvinyl Alcohol (PVA), Carboxymethyl Cellulose (CMC), Polyamide (PA), Polycarbonate (PC), Polyethylene (PE), Polypropylene (PP), Polystyrene (PS), Polyurethanes (PU), and any combinations of the above.

Further, the silver particles manufacturing method includes the following steps: adding the polymer additive into the silver ion solution, and stir them to dissolve the polymer additive completely, to obtain a silver ion solution containing polymer (step S250).

In addition, the silver particles manufacturing method further includes the following steps: performing ultrasonic vibrations or a heating process for the silver ion solution containing polymer, and then let the solution settle down for a period of time, to obtain a silver particles synthesized solution (step S260). In the step mentioned above, the heating temperature is 30° C. to 110° C., and the heating is performed for a period of 1 second to 10 hours. On the other hand, the power required for the ultrasonic vibrations is 10 W to 1600 W, while the ultrasonic vibration is performed for a period of 1 second to 10 hours. Further, the settle-down period is 1 to 30 days.

Further, the silver particles manufacturing method includes the following steps: placing the silver particles synthesized solution into a centrifuge to perform centrifugation and separation, to obtain nm-scale silver particles (upper layer solution) and μm-scale silver particles (lower layer powder). Then the particles are rinsed with acetone several times, to complete manufacturing the nm-scale silver particles and the μm-scale silver particles (step S270). In the step mentioned above, the rotation speed of the centrifuge is 100 rpm to 15000 rpm, while the centrifugation is performed for a period of 1 second to 10 hours. But the present invention is not limited to this.

In the following, various embodiments are described in explaining the technical characteristics of the present invention. Wherein, embodiments 1-4 and embodiments 5-8 belong to the first category embodiment; while embodiments 9-12 and embodiments 13-16 belong to the second category embodiment.

Embodiments 1-4

Put silver nitride ($AgNO_3$) powder of 15%, 20%, 30%, and 60% (w/w) respectively into 2 g N-Methyl Pyrrolidone (NMP) solution, and then perform ultrasonic vibrations to make the silver nitride ($AgNO_3$) powder dissolve completely, to obtain the silver ion solution. Subsequently, perform heating process in a temperature of 65° C., 75° C., and 85° C. respectively for two hours for the silver ion solution thus obtained, then place the solution for settle-down period as required, to obtain the synthesized silver particles solution. In case the settle-down period is 1-5 days, then the nm-scale silver particles can be obtained. Further, in case the settle-down period is over 6 days, then the μm-scale silver particles can be obtained. Finally, place the synthesized silver particles solution into a high speed centrifuge to rotate at 10000 rpm for 20 minutes, to obtain nm-scale silver particles (upper layer solution) and μm-scale silver particles (lower layer powder), then rinse the particles with acetone several times, to complete manufacturing the nm-scale silver particles and the μm-scale silver particles. The results of the steps mentioned above can be summarized in Table 1 as follows:

TABLE 1

| embodiment | $AgNO_3$ content (w/w) | reaction temperature (° C.) 65 | 75 | 85 |
|---|---|---|---|---|
| 1 | 15 | + | + | + |
| 2 | 20 | + | + | + |
| 3 | 30 | + | + | + |
| 4 | 60 | + | + | + |

+: indicates that silver particles can be obtained
−: indicates that no silver particles can be obtained

Embodiments 5-8

Put silver nitride ($AgNO_3$) powder of 15%, 20%, 30%, and 60% (w/w) respectively into 2 g N-Methyl Pyrrolidone (NMP) solution, and then perform ultrasonic vibrations to make the silver nitride ($AgNO_3$) powder dissolve completely, to obtain the silver ion solution. Subsequently, perform ultrasonic vibrations for 2, 3, 4, 5 hours respectively for the silver ion solution thus obtained, then place the solution in a settle-down period as required, to obtain the synthesized silver particles solution. In case the settle-down period is 1-5 days, then the nm-scale silver particles can be obtained. Further, in case the settle-down period is over 6 days, then μm-scale silver particles can be obtained. Finally, place the synthesized silver particles solution into a high speed centrifuge to rotate at 10000 rpm for 20 minutes, to obtain nm-scale silver particles (upper layer solution) and μm-scale silver particles (lower layer powder), then rinse the particles with acetone several times, to complete manufacturing the nm-scale silver particles and the μm-scale silver particles. The results of the steps mentioned above can be summarized in the Table 2. as follows.

TABLE 2

| embodiment | $AgNO_3$ content (w/w) | ultrasonic vibration period (hr) 2 | 3 | 4 | 5 |
|---|---|---|---|---|---|
| 5 | 15 | + | + | + | + |
| 6 | 20 | + | + | + | + |
| 7 | 30 | + | + | + | + |
| 8 | 60 | + | + | + | + |

+: indicates that silver particles can be obtained
−: indicates that silver particles can not be obtained

Embodiments 9-12

Put silver nitride ($AgNO_3$) powder of 15%, 20%, 30%, and 60% (w/w) respectively into 2 g N-Methyl Pyrrolidone (NMP) solution, and then perform ultrasonic vibrations to make the silver nitride ($AgNO_3$) powder dissolve completely, to obtain a silver ion solution. Subsequently, add polymer additive of Poly (Methyl Methacrylate) (PMMA) or Polyethylene Terephthalate (PET) of 1 wt %, 2 wt %, and 3 wt % respectively into the silver ion solution, to obtain a silver ion solution containing polymer. Then, perform ultrasonic vibrations until the polymer is completely dissolved. Then, perform heating process in a temperature of 65° C., 75° C., and 85° C. respectively for two hours, and then place the solution in settle-down period as required, to obtain the synthesized silver particles solution. In case the settle-down period is 1-5 days, then the nm-scale silver particles can be obtained. Further, in case the settle-down period is over 6 days, then μm-scale silver particles can be obtained. Finally, place the synthesized silver particles solution into a high speed centrifuge to rotate at 10000 rpm for 20 minutes, to obtain nm-scale silver particles (upper layer solution) and μm-scale silver particles (lower layer powder). Then, rinse the particles with acetone several times, to complete manufacturing the nm-scale silver particles and the μm-scale silver particles. The results of the steps mentioned above can be summarized in Table 3 as follows:

TABLE 3

| embodiment | $AgNO_3$ content (w/w) | polymer content (w/w) | reaction temperature (° C.) 65 | 75 | 85 |
|---|---|---|---|---|---|
| 9 | 15 | 1 | + | + | + |
| | | 2 | + | + | + |
| | | 3 | + | + | + |
| 10 | 20 | 1 | + | + | + |
| | | 2 | + | + | + |
| | | 3 | + | + | + |
| 11 | 30 | 1 | + | + | + |
| | | 2 | + | + | + |
| | | 3 | + | + | + |
| 12 | 60 | 1 | − | − | − |
| | | 2 | − | − | − |
| | | 3 | − | − | − |

+: indicates that silver particles can be obtained
−: indicates that no silver particles can be obtained Embodiments 13-16

Put silver nitride ($AgNO_3$) powder of 15%, 20%, 30%, and 60% (w/w) respectively into 2 g N-Methyl Pyrrolidone (NMP) solution, and then perform ultrasonic vibrations to make the silver nitride ($AgNO_3$) powder dissolve completely, to obtain a silver ion solution. Subsequently, add polymer additive of Poly (Methyl Methacrylate) (PMMA) or Polyethylene Terephthalate (PET) of 1 wt %, 2 wt %, and 3 wt % respectively into the silver ion solution, to obtain a silver ion solution containing polymer. Then, perform ultrasonic vibrations until the polymer is completely dissolved. Then, perform ultrasonic vibrations for 2, 3, 4, 5 hours respectively, then place the solution for settle-down period as required, to obtain the synthesized silver particles solution. In case the settle-down period is 1-5 days, then nm-scale silver particles can be obtained. Further, in case the settle-down period is over 6 days, then μm-scale silver particles can be obtained. Finally, place the synthesized silver particles solution into a high speed centrifuge to rotate at 10000 rpm for 20 minutes, to obtain nm-scale silver particles (upper layer solution) and μm-scale silver particles (lower layer powder). Then, rinse the particles with acetone several times, to complete manufacturing the nm-scale silver particles and the μm-scale silver particles. The results of the steps mentioned above can be summarized in Table 4 as follows:

TABLE 4

| | AgNO3 content | polymer content | ultrasonic vibration period (hr) | | | |
|---|---|---|---|---|---|---|
| embodiment | (w/w) | (w/w) | 2 | 3 | 4 | 5 |
| 13 | 15 | 1 | + | + | + | + |
| | | 2 | + | + | + | + |
| | | 3 | + | + | + | + |
| 14 | 20 | 1 | + | + | + | + |
| | | 2 | + | + | + | + |
| | | 3 | + | + | + | + |
| 15 | 30 | 1 | + | + | + | + |
| | | 2 | + | + | + | + |
| | | 3 | + | + | + | + |
| 16 | 60 | 1 | − | − | − | − |
| | | 2 | − | − | − | − |
| | | 3 | − | − | − | − |

+: indicates that silver particles can be obtained
−: indicates that silver particles can not be obtained The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements that are within the scope of the appended claims.

What is claimed is:

1. A silver particles manufacturing method, comprising following steps:

providing a silver nitrate ($AgNO_3$);

providing a N-Methyl Pyrrolidone (NMP) solution;

adding the silver nitrate ($AgNO_3$) into the N-Methyl Pyrrolidone (NMP) solution, to perform ultrasonic vibrations until the silver containing compound is dissolved completely into the organic solution, to form a silver ion solution, wherein silver ion concentration of the silver ion solution is 0.001M to 10M;

performing the ultrasonic vibrations without additional reducing agent for 2 to 5 hours, and then let the solution settle down for a period, to form a silver particles synthesized solution; and placing the silver particles synthesized solution into a centrifuge to perform centrifugation and separation, to obtain μm-scale silver particles and nm-scale silver particles, wherein power of the ultrasonic vibrations is 10 W to 1600 W.

2. The silver particles manufacturing method as claimed in claim 1, wherein rotation speed of the centrifuge is in a range of 100 rpm to 15000 rpm.

3. A silver particles manufacturing method, comprising following steps:

providing a silver nitrate ($AgNO_3$);

providing a N-Methyl Pyrrolidone (NMP) solution;

adding the silver nitrate ($AgNO_3$) into the N-Methyl Pyrrolidone (NMP) solution, to perform ultrasonic vibrations until the silver containing compound is dissolved completely into the organic solution, to form a silver ion solution;

providing a polymer additive for raising yield of the silver particles;

putting the polymer additive into the silver ion solution, to form a silver ion solution containing polymer, wherein silver ion concentration of the silver ion solution is 0.001M to 10M;

performing the ultrasonic vibrations for the silver ion solution containing polymer without additional reducing agent for 2 to 5 hours, and then let it settle down for a period, to form a silver particles synthesized solution; and placing the silver particles synthesized solution into a centrifuge to perform centrifugation and separation, to obtain μm-scale particles and nm-scale particles, wherein power of the ultrasonic vibrations is 10 W to 1600 W.

4. The silver particles manufacturing method as claimed in claim 3, wherein the polymer additive is selected from one of following group consisting of: Polyethylene Terephthalate (PET), Poly (Methyl Methacrylate) (PMMA), Polyvinylidene Fluoride (PVDF), Polyvinyl Alcohol (PVA), Carboxymethyl Cellulose (CMC), Polyamide (PA), Polycarbonate (PC), Polyethylene (PE), Polypropylene (PP), Polystyrene (PS), Polyurethanes (PU), and any combinations of the above.

5. The silver particles manufacturing method as claimed in claim 3, wherein concentration of the polymer additive is 1 wt % to 3 wt %.

6. The silver particles manufacturing method as claimed in claim 3, wherein rotation speed of the centrifuge is in a range of 100 rpm to 15000 rpm.

* * * * *